United States Patent [19]

Bishop, Jr. et al.

[11] 4,286,247

[45] Aug. 25, 1981

[54] TEMPERATURE RESPONSIVE DEVICE

[75] Inventors: George H. Bishop, Jr., Carlisle; William J. Croft, Natick, both of Mass.

[73] Assignee: The United States of America as represented by the Secretary of the Army, Washington, D.C.

[21] Appl. No.: 84,965

[22] Filed: Oct. 15, 1979

[51] Int. Cl.[3] ..... H01H 37/76

[52] U.S. Cl. ..... 337/402; 337/406

[58] Field of Search ..... 337/401, 402, 403, 404, 337/405, 406, 407, 408, 409

[56] References Cited

U.S. PATENT DOCUMENTS

| | | | |
|---|---|---|---|
| 2,955,179 | 10/1960 | Milton et al. | 337/403 |
| 3,291,945 | 12/1966 | Merrill et al. | 337/403 |
| 3,952,274 | 4/1976 | Plasko | 337/407 |
| 3,956,725 | 5/1976 | Merrill et al. | 337/407 |
| 4,080,586 | 3/1978 | Hay | 337/407 |
| 4,179,679 | 12/1979 | Houghland | 337/407 |

*Primary Examiner*—George Harris

*Attorney, Agent, or Firm*—Nathan Edelberg; Robert P. Gibson; Max Yarmovsky

[57] ABSTRACT

A container is partially filled with a meltable body that has a predetermined melting point. An actuating member is arranged to translate through the container and displace the meltable body upon its melting.

5 Claims, 5 Drawing Figures

FIG. 1
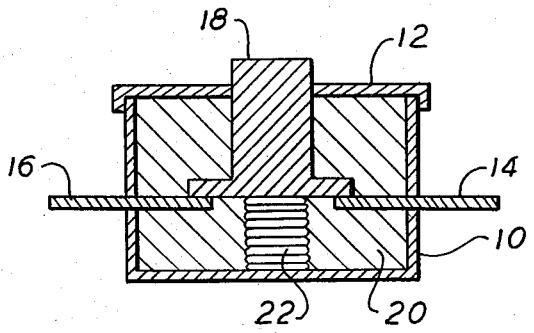
FIG. 2
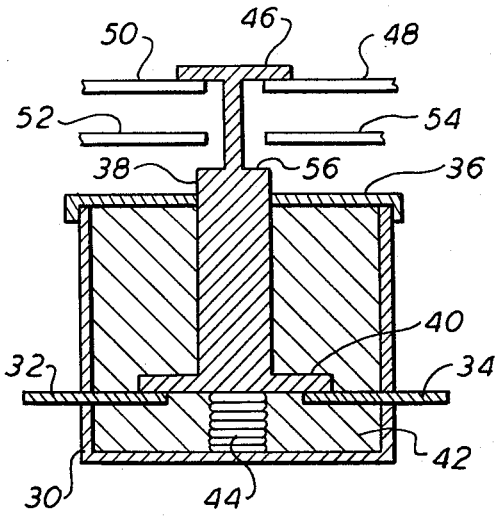
FIG. 3
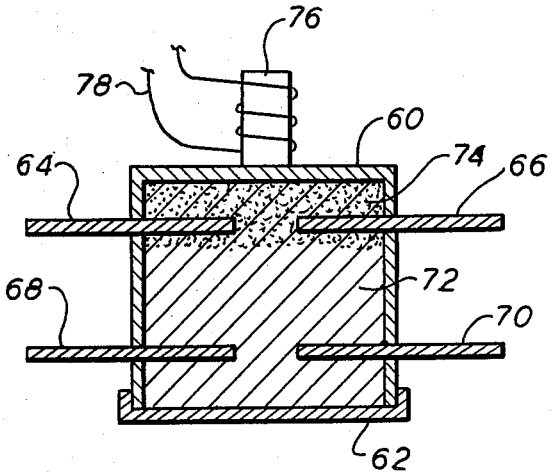
FIG. 4
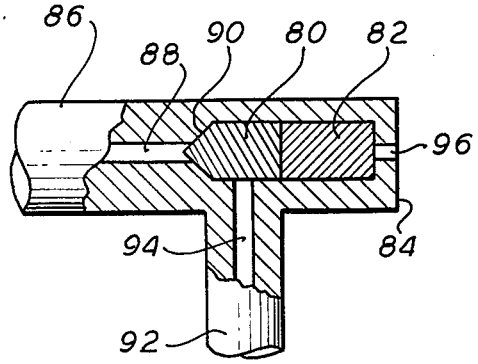
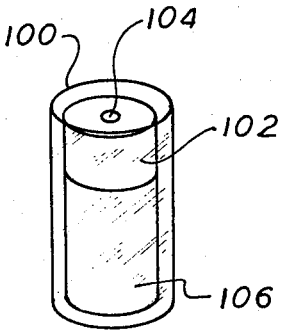
FIG. 5

TEMPERATURE RESPONSIVE DEVICE

GOVERNMENT INTEREST

The invention described herein may be manufactured, used and licensed by or for the government for governmental purposes without the payment to us of any royalties thereon.

BACKGROUND OF THE INVENTION

The present invention relates to temperature responsive devices and in particular to containers having meltable bodies therein.

Meltable devices are generally used for fire sprinkling systems, slow-blow fuses, thermal overload devices for electrical motors etc. Known thermal switches employ a metallic conductor that has a preselected melting point. This metallic conductor is arranged so that when this preselected temperature is exceeded, the element parts, interrupting the electrical current flowing through it. These known devices employ relatively expensive, toxic metal alloys, such as bismuth, antimony, tin, lead, cadmium, or mercury. In addition, being metallic these devices have electrical limitations. Care must be taken that melted elements do not inadvertently short adjacent circuitry. Furthermore, these metallic alloys have relatively higher melting points which limit their applications.

It is desirable to have a thermally responsive device which can actuate electrical, fluidic or mechanical devices. In addition it is desirable to have a simple thermal device which provides a visual indication of whether a predetermined temperature has been exceeded. It is also desirable that the thermal device be designable to operate reversibly or irreversibly.

The present invention can provide these features and advantages by employing an actuating member and a meltable body within a container. In one embodiment a spring loaded switch is held in a closed position by a surrounding medium such as paraffin. This thermal switch can be designed to open at a relatively moderate temperature. Moreover, if a non-conductor such as paraffin is employed electrical operation is not significantly affected by this meltable medium. Accordingly, contact design can be implemented without undue concern for the strength or conductivity associated with the meltable medium. In addition, such a spring loaded switch can be designed so that if temperature recedes and the meltable medium solidifies, the switch does not reset. Alternativley, the electrical contacts for the spring loaded switch can be physically located outside the meltable medium. this feature allows the electrical contacts to operate without touching the meltable medium.

In another embodiment of the present invention a multiplicity of conductive granules are embeded in a meltable body at the interspace between two electrodes. This device is arranged so that when the meltable body melts the metallic granules migrate with respect to these electrodes. This arrangement can be designed to provide either a normally closed or open switch. The migration characteristics of the granules can be influenced by an electromagnet which can cause the granules to migrate in any direction including upward.

In another embodiment a meltable plug is used to hold a valve member against a valve seat. Upon melting of the meltable body the valve is opened by fluid pressure.

In a situation where physical operation of accessories is not desired, a device incorporating principles of the present invention employs a transparent container so that temperature conditions are indicated visually. For example, a weight in the upper part of a transparent container may be supported by a meltable body. In the event a predetermined temperature is exceeded, the weight decends through the melted medium thereby providing a visual indication of excessive temperatures. Such an arrangement can be reversible. Thus, the transparent container can be inverted and heated to restore the weight to its original position.

SUMMARY OF THE INVENTION

In accordance with the illustrative embodiments demonstrating features and advantages of the present invention there is provided a temperature responsive device. This device includes a container and a meltable body partially filling the container. This meltable body is meltable at a predetermined temperature. The temperature responsive device also includes an actuating member arranged to translate through the container and displace the meltable body upon its melting.

BRIEF DESCRIPTION OF THE DRAWING

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein:

FIG. 1 is a sectional view of a temperature responsive device in accordance with the present invention;

FIG. 2 is a sectional view of an embodiment that is an alternate to that of FIG. 1;

FIG. 3 is a sectional view of an embodiment that is an alternate to that of FIG. 1;

FIG. 4 is another embodiment of a temperature responsive device in accordance with the present invention which is designed to control a fluid instead of electrical current;

FIG. 5 is an isometric view of another embodiment of a device in accordance with the present invention which is designed to provide a visual indication.

DETAILED DESCRIPTION OF THE PREFERRED EMBODIMENTS

Referring to FIG. 1, there is shown a temperature responsive device comprising a container, shown herein as cylindrical cup 10. Fitted over the upper mouth of container 10 is perforated lid 12. Inserted through opposite apertures in the sidewall of container 10 are a pair of opposing spaced electrodes 14 and 16. Shown in electrical contact with electrodes 14 and 16 is an actuating member, being shown herein as plunger 18. While plunger 18 is shown as a cylinder having a larger lower cylindrical disc for bridging electrodes 14 and 16, clearly other shapes are possible. Surrounding plunger 18 and holding it in contact with electrodes 14 and 16 is a meltable body 20, shown herein as a paraffin medium encapsulating components within container 10.

While paraffin is described above it is to be understood that many different mediums can be used instead. The material chosen will depend upon the application, the thermal time delays and threshold temperature at which the switch must operate. It is also anticipated that eutectioc mixtures may be used. The following materials are listed as examples of the various meltable bodies which may be employed and their corresponding melting points (in degrees centigrade):

| | |
|---|---|
| Acrylic Acid | 12.3 |
| Acetophenone | 19.7 |
| Phenol | 41 |
| Thymol | 51.5 |
| Bismuth Triphenyl | 78 |
| Acetamide | 81 |
| d,l-Tartaric Acid . $H_2O$ | 100 |
| Sulfur | 112.8 |
| Acetanalide | 114 |
| Calcium Stearate | 180 |
| Sodium Acetate | 324 |
| Sodium Chloride | 801 |

It is anticipated that not only will the various meltable bodies be chosen with regard to their melting points but their solubility, reactiveness with water, transparency, vapor pressure etc.

A bias means is shown herein as compressed coil spring 22 which is positioned between the floor of container 10 and the lower surface of plunger 18. While a coil spring is shown herein, it is anticipated that various yieldable devices or magnetic devices may be used instead to draw plunger 18 away from the position shown. It is also anticipated that in embodiments requiring normally open contacts, the electrodes will be spaced above the lower rim of the plunger.

To facilitate an understanding of the principles of the present invention, the operation of the apparatus of FIG. 1 will be briefly described. The device of FIG. 1 is assembled by mechanically depressing spring 22 and plunger 18 until it makes electrical contact across electrodes 14 and 16. Next, container 10 is filled with melted paraffin. Lid 12 is then placed in position and the device is allowed to solidify. Once solidified an electrical circuit can be connected between electrodes 14 and 16 to provide continuity therebetween.

Should the ambient surrounding container 10 increase sufficiently, eventually medium 20 melts at which point plunger 18 is free to move. Accordingly, spring 20 urges plunger 18 upward thereby interrupting the electrical circuit between electrodes 14 and 16. It is to be noted that when the temperature falls below the melting point of body 20, the electrical circuit nevertheless remains open. In this sense the operation of the switch of FIG. 1 is irreversible. Of course the device may be reheated and the plunger 18 mechanically depressed to reset the switch. In this latter sense the switch of FIG. 1 is reversible.

Referring to FIG. 2, an alternate embodiment is shown comprising cup-shaped, cylindrical container 30 which has mounted through opposing side walls electrodes 32 and 34. Container 30 is covered with apertured lid 36. Protruding through lid 36 is plunger 38 whose lower disc 40 is flared to bridge and make electrical contact with electrodes 32 and 34. Surrounding and holding plunger 38 in position is meltable body 42. Positioned between the floor of container 30 and the lower face of plunger 38 is coil spring 44. Plunger 38 differs from plungers previously described in that it has a mushroom-shaped upper portion 46 which, as shown, bridges and makes electrical contact with electrodes 48 and 50, the latter two electrodes being mechanically and electrically connected to surrounding equipment (not shown). Another similar pair of spaced electrodes 52 and 54 are shown positioned above shoulder 56 of plunger 38. Shoulder 56 and eletrodes 52 and 54 are aligned so that upon the rising of plunger 38, electrical continuity can be effected between electrodes 52 and 54.

The operation of the electrodes 32 and 34 of FIG. 2 is similar to that previously described in connection to FIG. 1. However, the apparatus of FIG. 2 has the additional feature of employing a normally open pair and normally closed pair of external contacts. Thus when body 42 melts, allowing plunger 38 to be upwardly driven by spring 44, the normally closed circuit between electrodes 50 and 48 is interrupted. Moreover, this upward movement causes plunger 38 to bridge and make electrical contact across electrodes 52 and 54.

Referring to FIG. 3 a container 60 is shown herein as an inverted, cup-shaped cylinder having its open mouth sealed by lid 62. Container 60 has two pairs of opposing electrodes mounted through its sidewalls. One pair is the upper pair of electrodes 64 and 66. The other pair is opposing lower electrodes 68 and 70. It is to be appreciated that for some embodiments, depending upon the application, only one pair of electrodes will be employed.

The balance of the interior of container 60 is filled with meltable body 72 whose upper portion is densely packed and impregnated with a multiplicity of electrically conductive magnetically attractable granules, shown herein as metallic powder 74. Powder 74 is so dense that electrical continuity is provided between electrodes 64 and 66. Also shown herein is a source of magnetic flux, shown herein as an electromagnet comprising core 76 wound with coil 78. It is to be appreciated that electro-magnet 76, 78 will not be required for all embodiments.

To facilitate an understanding the principles of the apparatus of FIG. 3, its operation will now be briefly described. The container 60 is initially filled by inverting it (mouth up) and filling it will metallic powder 74. Thereafter melted paraffin 72 is poured into the container 70 which is then sealed with lid 62, time being given to allow paraffin 72 to solidify. Thus prepared, the device has electrical continuity between electrodes 64 and 66. If installed in the position shown (powder 74 in the upward position) and the ambient exceeds the melting point of paraffin 72, powder 74, by virtue of its greater density, settles towards the bottom of container 60. Such migration interrupts the electrical continuity between electrodes 64 and 66. Eventually the granules of powder 74 settle so compactly around electrodes 68 and 70 that electrical continuity is provided between electrodes 68 and 70.

This migration can be upwardly directed towards electromagnet 76,78 by the influence of the magnetic flux issuing therefrom. This latter feature can be important where it is desired to reset the switch of FIG. 3 or where the switch is mounted on a vehicle which can be randomly oriented. Alternatively, the electromagnet 76, 78 can be advantageously employed where migration time caused by gravity is unsatisfactory.

Referring to FIG. 4, there is shown a valve device 80 which is contiguous to cylindrical meltable body 82. The latter items are mounted within a container which is essentially one branch of a T-shaped conduit 84. Conduit 84 has an inlet branch 86 with a passageway 88 leading to a valve seat 90. Outlet branch 92 contains passageway 94. In this embodiment passageway 88, valve 80 and meltable body 82 are essentially coaxial and cylindrical, except that valve 80 has a conical end that matches valve seat 90. Also coaxially aligned with the foregoing is circular aperture 96 which vents the container in which valve 80 and meltable body 82 are located.

to facilitate an understanding of the apparatus of FIG. 4 its operation will be briefly described. A source of pressurized fluid such as water is connected to the extreme (left) end of branch 86. Fluid pressure conducted through passageway 88 is applied to valve 80 which is sealed to seat 90 by virtue of meltable body 82. Valve 80 and meltable body 82 are dimensioned to firmly press valve 80 onto valve seat 90. Accordingly, no fluid flows from passageway 88 to passageway 94. In the event that ambient temperature exceeds the melting point of meltable body 82, valve 80 becomes free to slide within its container. Fluid pressure applied to valve 80 causes it to translate in a direction towards aperture 96. Accordingly, meltable body 82 is extruded through aperture 96. This process continues and eventually opens a passage between passageway 88 and passageway 94. Thus, the foregoing apparatus provides a temperature responsive valve which opens in the event a predetermined temperature is exceeded.

Referring to FIG. 5, there is shown a transparent container which is fabricated as a closed, hollow, glass cylinder 100. Slidably mounted within container 100 is actuating member 102, comprising a relatively heavy metal cylindrical weight with coaxial throughbore 104. Filling the space below weight 102 is meltable body 106, comprised of paraffin in this embodiment.

This device is employed to provide a visual indication of whether a predetermined temperature has been exceeded. When the ambient exceeds the melting point of meltable body 104, weight 102 translates downwardly displacing meltable body 106 upwardly through bore 104. Accordingly, an operator can visually verify whether a given temperature has been exceeded by observing whether weight 102 is in an upward or downward position. Obviously, this device can be simply reset by the expedient of inverting it. Alternatively it can be temporarily inverted and heated causing weight 102 to return to its initial position.

It is appreciated that modifications and alterations can be implemented with respect to the apparatus just described. For example, various spring loaded devices can be used to operate mechanical devices. For example clutches can be engaged or disengaged when a given temperature is exceeded. Clearly many other mechanical, hydraulic, electro-mechanical and other devices can be controlled or regulated by devices according to the principles herein given. In addition, various materials can be substituted for those previously described. Furthermore the shapes of various containers, electrodes, plungers etc. can be modified to provide the desired strength, wear, power, current conducting capability etc.

Obviously many other modifications and variations of the present invention are possible in light of the above teachings. It is therefore to be understood that within the scope of the appended claims, the invention may be practiced otherwise than as specifically described.

What is claimed is:

1. A resettable temperature responsive device comprising:

a container;

a meltable body partially filling said container;

activating means for translating through said container under the influence of gravity upon the melting of said meltable body;

terminal means for providing electrical connections which can be electrically opened and closed upon movement of said activating means; and means for electro-magnetically resetting said device after said meltable body has melted.

2. A temperature responsive device according to claim 1 wherein said actuating means includes:

a first pair of electrodes mounted in the upper portion of said container;

a plurality of electrically conductive magnetically attractable granules densely located in the interspace between said first pair of electrodes, said granules being of a relative density to allow downward settling thereof upon the melting of said meltable body, whereby electrical continuity between said electrodes is interrupted for temperatures exceeding a predetermined temperature; and a second pair of electrodes operatively mounted in the lower portion of said container.

3. A temperature responsive device according to claim 1, or 2, wherein said means for electro-magnetically resetting further comprises:

a source of magnetic flux mounted adjacent to said container having an intensity sufficient to displace said actuating member through said meltable body upon the melting thereof.

4. A temperature responsive device according to claim 3, wherein said source of magnetic flux comprises an electro-magnet.

5. A temperature responsive device as recited in claim 1 wherein said meltable body comprises materials having melting points which range from 12.3°–801° C.

* * * * *